United States Patent [19]

Nakajima et al.

[11] Patent Number: 4,788,958

[45] Date of Patent: Dec. 6, 1988

[54] METHOD OF AIR/FUEL RATIO CONTROL FOR INTERNAL COMBUSTION ENGINE

[75] Inventors: Toyohei Nakajima; Yasushi Okada; Toshiyuki Mieno; Nobuyuki Oono, all of Wako, Japan

[73] Assignee: Honda Giken Kogyo Kabushiki Kaisha, Tokyo, Japan

[21] Appl. No.: 42,213

[22] Filed: Apr. 24, 1987

[30] Foreign Application Priority Data

Apr. 24, 1986 [JP] Japan ..... 61-096032

[51] Int. Cl.[4] ..... F02M 51/00

[52] U.S. Cl. ..... 123/489

[58] Field of Search ..... 123/440, 489, 589

[56] References Cited

U.S. PATENT DOCUMENTS 4,131,089 12/1978 Fujishino et al. ..... 123/440
4,170,965 10/1979 Aono ..... 123/440
4,177,787 12/1979 Hattori et al. ..... 123/440 X
4,178,883 12/1979 Herth ..... 123/440
4,240,389 12/1980 Shimazaki ..... 123/440 X

*Primary Examiner*—William E. Tapolcai
*Attorney, Agent, or Firm*—Birch, Stewart, Kolasch & Birch

[57] ABSTRACT

A method of engine air/fuel ratio control using an oxygen concentration sensor producing a concentration-proportional output, in which a compensation value is computed for compensating a basic value such as a basic fuel injection time interval, and in which a deviation of an air/fuel ratio detected using the oxygen concentration sensor from a target air/fuel ratio is measured the compensation value is computed and updated only under the condition that the deviation is below a predetermined value, with the compensation value being determined in accordance with the amount of deviation.

8 Claims, 12 Drawing Sheets

| FIG. 3a | FIG. 3b |
|---|---|

109
$K_{O2Pn} = K_{OP} \cdot \Delta AFn$
110
SEARCH FOR $K_{OI}$
111
READ OUT $K_{O2I(n-1)}$
112
$K_{O2In} = K_{O2I(n-1)} + K_{OI} \cdot \Delta AFn$
113
READ OUT $_{\Delta}AF_{(n-1)}$
114
$K_{O2Dn} = K_{OD} (\Delta AF_{(n-1)} - \Delta AFn)$
115
$K_{O2} = K_{O2Pn} + K_{O2In} + K_{O2Dn}$
116
$|AF_{ACT} - AF_{TAR}| \leq 0.5$
NO
YES
117
$K_{O2} = K_1$
118
$(-1)^n > 0$
NO
YES
119
$K_{O2} = K_{O2} + P_1$
120
$K_{O2} = K_{O2} - P_1$
RETURN KREF COMPUTATION SUBROUTINE
READ OUT KREF FROM (i,j) KREF(n-1) = KREF
131
|AFACT-AFTAR| ≦ DAF4
132
YES
NO
|AFACT-AFTAR| ≦ DAF5
133
YES
NO
KREF = CREFN · (KO2 - 1.0) + KREF(n-1)
134
KREF = CREFW · (AFACT · KO2-AFTAR) + KREF(n-1)
135

METHOD OF AIR/FUEL RATIO CONTROL FOR INTERNAL COMBUSTION ENGINE

BACKGROUND OF THE INVENTION

1. Field of the Invention

The present invention relates to a method of air/fuel ratio control for an internal combustion engine.

2. Description of Background Information

In order to reduce the level of exhaust gas pollutants and improve the fuel consumption of an internal combustion engine, it is known to employ an oxygen concentration sensor for the detection of the concentration of oxygen in the engine exhaust gas, and to use feedback control to maintain the air/fuel mixture supplied to the engine at a targeted air/fuel ratio. This feedback control is performed using with an output signal from the oxygen concentration sensor.

One type of oxygen concentration sensor which can be employed for such air/fuel ratio control produces an output which varies in proportion to the oxygen concentration in the engine exhaust gas. This oxygen concentration sensor is disclosed in Japanese patent laid-open No. 52-72286. This oxygen concentration sensor consists of one oxygen ion-conductive solid electrolytic member formed as a flat plate having a pair of electrodes respectively formed on its two main faces, with one of these electrode faces forming part of a gas holding chamber. The gas holding chamber communicates with the exhaust gas to be measured, through a lead-in aperture. The oxygen ion-conductive solid electrolytic member and its pair of electrodes function as an oxygen pump element. By passing current between the electrodes, the electrode within the gas holding chamber will become a negative electrode, and the oxygen gas within the gas holding chamber adjacent to this negative electrode will become ionized and flow through the solid electrolytic member towards the positive electrode. The ionized oxgyen is then emitted from the face of the pump element as gaseous oxygen. The current flow between the electrodes is lower than a boundary current value which is substantially constant. Thus it is substantially unaffected by variations in the applied voltage and is proportional to the oxygen concentration within the gas being measured. Therefore, by sensing the level of this boundary current the oxygen concentration of the exhaust gas can be measured. However, if the oxygen concentration sensor is used to control the air/fuel ratio of the mixture supplied to an internal combustion engine, by measuring the oxygen concentration within the engine exhaust gas, the air/fuel ratio can only be maintained at a value in the lean region relative to the stoichiometric air/fuel ratio. It is not possible to maintain the air/fuel ratio control to at targeted air/fuel ratio in the rich region. An oxygen concentration sensor which will provide an output signal level varying substantially in proportion to the oxygen concentration in engine exhaust gas for both the lean region and the rich region of the air/fuel ratio has been disclosed in Japanese patent laid-open No. 59-192995. This sensor consists of two oxygen ion-conductive solid electrolytic members each formed as a flat plate and provided with a pair of electrodes. Two opposing electrode faces, one face of each of the solid electrolytic members, form part of a gas holding chamber which communicates the gas to be measured via a lead-in aperture. The other electrode of one of the solid electrolytic members faces the atmosphere. One of the solid electrolytic members and its electrodes functions as an oxygen concentration ratio sensor cell element. The other solid electrolytic member and its electrodes functions as an oxygen pump element. If the voltage which is generated between the electrodes of the oxygen concentration ratio sensor cell element is higher than a reference voltage value, the current will flow between the electrodes of the oxygen pump element such that the oxygen ions flow through the oxygen pump element towards the electrode of the element within the gas holding chamber. If the voltage developed between the electrodes of the sensor cell element is lower than the reference voltage value, the current will flow between the electrodes of the oxygen pump element such that the oxygen ions flow through the element towards the oxygen pump element electrode located on the opposite side to the gas holding chamber. In this way, a value for current flow between the electrodes of the oxygen pump element can be measured. This value varies substantially in proportion to the oxygen concentration in the exhaust gas, both in the rich and the exhaust lean regions in the air/fuel ratio.

However when an oxygen concentration sensor producing a varied output in proportion to the oxygen concentration is employed, variations in the sensors detecting characteristics and deteriorations of the sensor will occur as time elapses. As a result, the accuracy of the correspondence between the basic value which is set in accordance with one or more engine parameters related to the engine load and the target air/fuel ratio will be reduced, so that errors will arise. One method which could be used to counteract this problem is to compute compensation values to compensate the errors in the basic value. In addition to storing the output from the oxygen concentration sensor, these compensation values can be stored as data in memory locations which are determined in accordance with the specific engine operating region at the time of the computation of the compensation value. When the computation of the output value is performed, the appropriate compensation value corresponding to the current operating condition of the engine would be obtained by searching the stored data, and the compensation value would be used to compensate the basic value. By using such a method, the compensation values are computed in accordance with the oxygen concentration sensor output. Thus, if the compensation was computed during a large change in the oxygen concentration of the exhaust gas, the accuracy of air/fuel ratio control can actually be reduced, and decreasing the effectiveness of the elimination of exhaust pollutants.

SUMMARY OF THE INVENTION

It is an objective of the present invention to provide a method of air/fuel ratio control employing an oxygen concentration sensor that provides an output varying in proportion to the oxygen concentration, whereby the method improves accuracy in control and enhances the elimination of exhaust gas pollutants, by accurately computing the compensation values used in compensating a basic value.

In the first preferred embodiment of the present invention using an air/fuel ratio control with one oxygen ion-conductive solid electrolytic member, the compensation values are computed and updated only when using the output of an oxygen concentration sensor the deviation of the air/fuel ratio from the target air/fuel ratio detected is below a predetermined value.

In the second preferred embodiment of the present invention using an air/fuel ratio control with two oxygen ion-conductive solid electrolytic members, the compensation values are computed and updated in accordance with the deviation of the air/fuel ratio from the target air/fuel ratio detected using the output of an oxygen concentration sensor when the deviation falls below a predetermined value.

More specifically, the present invention provides a method for air/fuel ratio control of a mixture supplied to an internal combustion engine which is equipped with an oxygen concentration sensor disposed in an exhaust system that produces an output that varies in proportion to an oxygen concentration in an exhaust gas of the engine, the method comprising:

setting a basic value ($t_i$) to control the air/fuel ratio in accordance with a plurality of engine operating parameters relating to engine load;

detecting the air/fuel ratio of the mixture based upon the oxygen concentration sensor output;

compensating the basic value by at least a compensation value when a deviation of the air/fuel ratio from a target air/fuel ratio is detected by utilizing the oxygen concentration sensor output, thereby determining an output value with respect to the target air/fuel ratio;

controlling the air/fuel ratio of the mixture in accordance with the output value; and computing and updating the compensation value when the deviation of the air/fuel ratio from a target air/fuel ratio detected from the output of the oxygen concentration sensor is lower than a predetermined value.

DETAILED DESCRIPTION OF EMBODIMENTS

Figure 1:
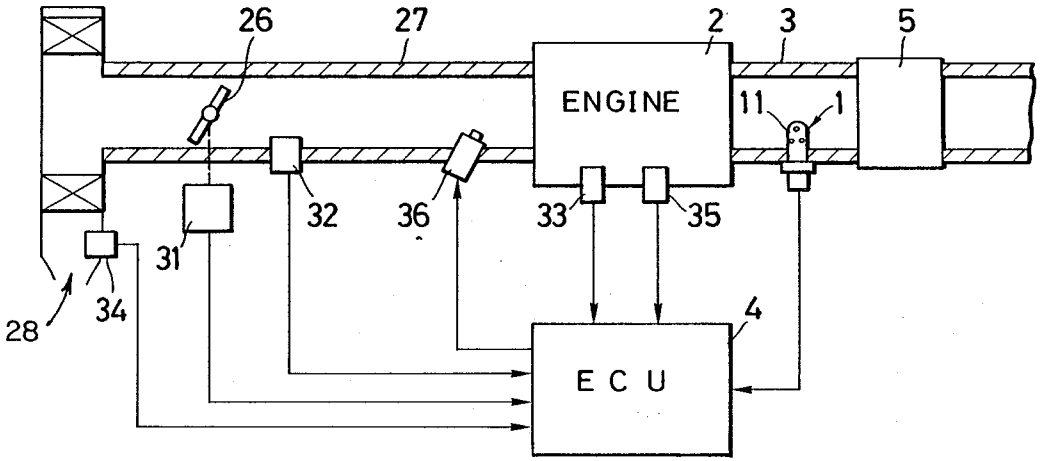
FIG. 1 is a diagram showing an electronic control fuel injection apparatus equipped with an oxygen concentration sensor, suitable for application in the abnormality detection method of the present invention.
Figure 2:
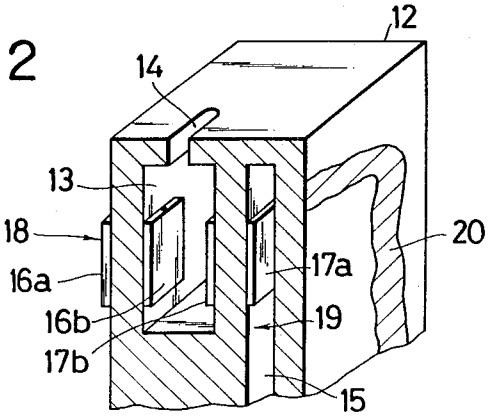
FIG. 2 is a diagram for illustrating the internal configuration of an oxygen concentration sensor detection unit.
Figures 3, 3A:
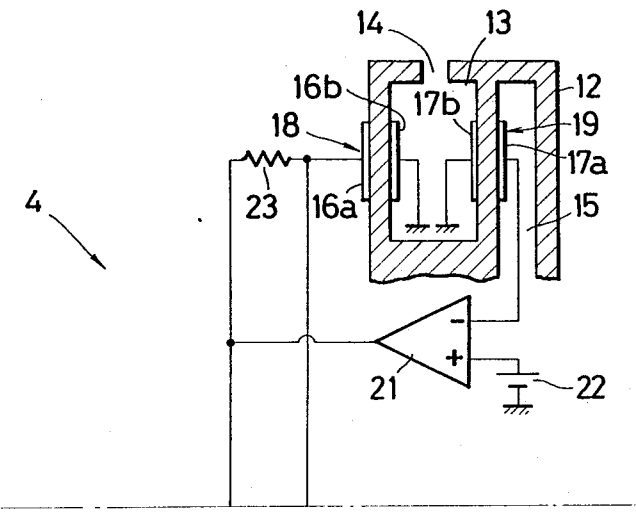
FIG. 3 is a block circuit diagram of the interior of an ECU (Electronic Control Unit)
Figure 3B:
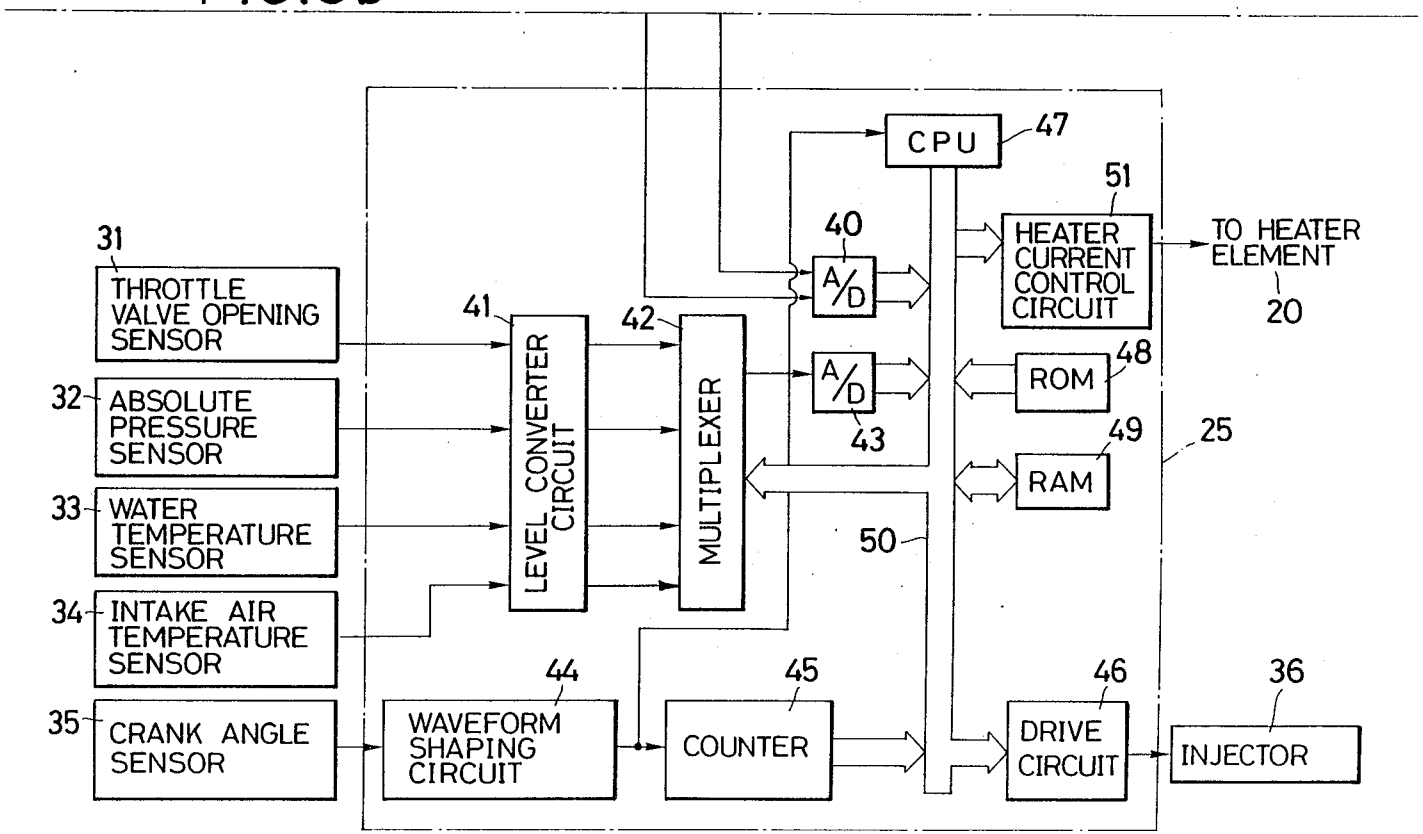

An embodiment of the present invention will now be described, referring to the drawings. FIGS. 1 through 3 show an electronic fuel control apparatus which utilizes the air/fuel ratio control method of the present invention. In this apparatus, an oxygen concentration sensor detection unit 1 is mounted within an exhaust pipe 3 of an engine 2, upstream from a catalytic converter 5. Inputs and outputs of the oxygen concentration sensor detection unit 1 are coupled to an ECU (Electronic Control Unit) 4.

A protective case 11 of the oxygen concentration sensor detection unit 1 contains an oxygen ion-conductive solid electrolytic member 12 having a substantially rectangular shape. The form is shown in FIG. 2. As seen in FIG. 2, a gas holding chamber 13 is formed in the interior of the solid electrolytic member 12, and communicates via a lead-in aperture 14 with the exhaust gas at the exterior of solid electrolytic member 12. The gas within the chamber constitutes the a gas to be sampled. The lead-in aperture 14 is positioned such that the exhaust gas will readily flow from the interior of the exhaust pipe into the gas holding chamber 13. In addition, an atmospheric reference chamber 15 is formed within the solid electrolytic member 12, into which atmospheric air is fed. The atmospheric reference chamber 15 is separated from the gas holding chamber 13 by a portion of the solid electrolytic member 12 serving as a partition. As shown, pairs of electrodes 17*a*, 17*b* and 16*a*, 16*b* are respectively formed on the partition between chambers 13 and 15 and on the wall of chamber 13 opposite to the chamber 15. The solid electrolytic member 12 functions in conjunction with the electrodes 16*a* and 16*b* as an oxygen pump element 18 and functions in conjunction with electrodes 17*a*, 17*b* as a sensor cell element 19. A heater element 20 is mounted on the external surface of the atmospheric reference chamber 15.

The oxygen ion-conductive solid electrolytic member 12 is formed of $ZrO_2$ (zirconium dioxide), while the electrodes 16*a* through 17*b* are each formed of platinum.

As shown in FIG. 3, ECU 4 includes an oxygen concentration sensor control section, consisting of a differential amplifier 21, a reference voltage source 22, and a resistor 23. Electrode 16*b* of the oxygen pump element 18 and electrode 17*b* of sensor cell element 19 are each connected to ground potential. Electrode 17*a* of sensor cell element 19 is connected to an input of operational amplifier 21, which produces an output voltage in accordance with the difference between the voltage appearing between electrodes 17*a*, 17*b* and the output voltage of reference voltage source 22. The output voltage of voltage source 22 corresponds to the stoichiometric air/fuel ratio, i.e. 0.4 V. The output terminal of operational amplifier 21 is connected through the current sensing resistor 23 to electrode 16*a* of the oxygen pump element 18. The terminals of current sensing resistor 23 constitute the output terminals of the oxygen concentration sensor, and are connected to the control circuit 25, which is implemented as a microprocessor.

A throttle valve opening sensor 31 which produces an output voltage in accordance with the degree of opening of throttle valve 26, and which can be implemented as a potentiometer, is coupled to control circuit 25. The control circuit is also connected an absolute pressure sensor 32 which is mounted in intake pipe 27 at a position downstream from the throttle valve which produces an output voltage varying in level in accordance with the absolute pressure within the intake pipe 27. A water temperature sensor 33 which produces an output voltage varying in level in accordance with the temperature of the engine cooling water, an intake temperature sensor 34 which is mounted near an air intake aperture 28 and produces an output at a voltage level in accordance with the intake air temperature, and a crank angle sensor 35 which generates signal pulses in synchronization with rotation of the crankshaft (not shown in the drawings) of engine 2 are also connected to control circuit 4. Moreover an injector 36 is mounted on intake pipe 27 near the intake valves (not shown in the drawing) of engine 2 and is connected to the control circuit.

Control circuit 4 includes an A/D converter 40 which receives the voltage developed across the current sensing resistor 23 as a differential input and converts that voltage to a digital signal. Control circuit 4 also includes a level converter circuit 41 which performs level conversion of each of the output signals from the throttle valve opening sensor 31, the absolute pressure sensor 32, the water temperature sensor 33, and the intake air temperature sensor 34. The resultant level-converted signals from level converter circuit 41 are supplied to inputs of a multiplexer 42. Control circuit 4 also includes an A/D converter 43 which converts the output signals from multiplexer 42 to digital form, a waveform shaping circuit 44 which executes waveform shaping operations on the output signal from the crank angle sensor 35 to produce TDC (top dead center) signal pulses as output, and a counter 45 which counts a number of clock pulses produced from a clock pulse generating circuit (which is not shown in the drawings) during each interval between successive TDC pulses from the waveform shaping circuit 44. Control circuit 25 further includes a drive circuit 46 for driving the injector 36, a CPU (central processing unit) 47 for performing digital computation in accordance with a program, a ROM (read-only memory) 48 storing the various processing programs and data therein, and a RAM (random access memory) 49. The A/D converters 40 and 43, multiplexer 42, counter 45, drive circuits 46, CPU 47, ROM 48 and RAM 49 are mutually interconnected by an input/output bus 50. The TDC signal is supplied directly from the waveform shaping circuit 44 to the CPU 47. The control circuit 25 also includes a heater current supply circuit 51, which can for example include a switching element responsive to a heater current supply command from CPU 47 for applying a voltage between the terminals of heater element 20, thereby supplying heater current and producing heating of heater element 20. RAM 49 is a non-volatile type of back-up memory, whose contents are not erased when the engine ignition switch (not shown in the drawings) is turned off.

Data representing a pump current value $I_P$ corresponding to the current flow through the oxygen pump element 18 is transferred from A/D converter 40, together with the data representing a degree of throttle valve opening $\theta_{TH}$, data representing the absolute pressure $P_{BA}$ within the intake pipe, and data representing the cooling water temperature $T_W$ and intake air temperature $T_A$, respectively selected and transferred by A/D converter 43, to CPU 47 via the I/O bus 50. In addition, a count value from counter 45, which is attained during each period of the TDS pulses, is supplied to CPU 47 via I/O bus 50. The CPU 47 executes read operations for each of these data values in accordance with the processing program is stored in the ROM 48, and computes a fuel injection time interval $T_{OUT}$ for injector 36 on the basis of this data in accordance with a fuel injection quantity for engine 2 that is determined from pre-existing equations. This computation is performed by means of a fuel supply routine executed in synchronism with the TDC signal. The injector 36 is then actuated by drive circuit 46 for the duration of the fuel injection time interval $T_{OUT}$, to supply fuel to the engine.

The fuel injection time interval $T_{OUT}$ can be obtained, as an example, from the following equation:

$$T_{OUT}=T_i\times K_{02}\times K_{REF}\times K_{WOT}\times K_{TW}+T_{ACC}+T_{DEC} \quad (1)$$

In the above equation, $T_i$ is a basic value for air/fuel ratio control constituting a reference injection time and determined by searching a data map stored in ROM 48 in accordance with the engine's rotational speed $N_e$ and the absolute pressure $P_{BA}$ in the intake pipe or manifold. $K_{02}$ is a feedback compensation coefficient for the air/fuel ratio, which is set in accordance with the output signal level from the oxygen concentration sensor. $K_{REF}$ is an air/fuel ratio feedback control automatic compensation coefficient i.e. a learning correction coefficient, which is determined by searching a data map stored RAM 49 in accordance with the engine's rotational speed $N_e$ and absolute pressure $P_{BA}$ within the intake pipe. $K_{WOT}$ is a fuel quantity increment compensation coefficient, which is applied when the engine is operating under high load. $K_{TW}$ is a cooling water temperature coefficient. $T_{ACC}$ is an acceleration increment value, and $T_{DEC}$ is a deceleration decrement value. $T_i$, $K_{02}$, $K_{REF}$, $K_{WOT}$, $K_{TW}$, $T_{ACC}$ and $T_{DEC}$ are respectively set by a subroutine in the fuel supply routine.

When the flow of pump current to the oxygen pump element begins and if the air/fuel ratio of the mixture which is supplied to engine 2 at that time is in the lean region, the voltage which is produced between electrodes **17*a* and 17*b* of the sensor cell element 19 will be lower than the output voltage from the reference voltage source 22, and as a result, the output voltage level from the differential amplifier 21 will be positive. This positive voltage is applied through the series-connected combination of resistor 23 and oxygen pump element 18. The pump current thereby flows from electrode 16*a* to electrode 16*b* of the oxygen pump element 18. This current flow causes the oxygen within the gas holding chamber 13 to become ionized by electrode 16*b* flow through the interior of oxygen pump element 18 from electrode 16*b*, and to be ejected from electrode 16*a* as gaseous oxygen. Oxygen is thereby drawn out from the interior of the gas holding chamber 13**.

As a result of this withdrawal of oxygen from the gas holding chamber 13, a difference in oxygen concentration will arise between the exhaust gas within gas holding chamber 13 and the atmospheric air within the atmospheric reference chamber 15. A voltage $V_S$ is produced between electrodes **17*a* and 17*b* of the sensor cell element 19 at a level determined by this difference in oxygen concentration. The voltage $V_S$ is also applied to the inverting input terminal of differential amplifier 21. The output voltage from the differential amplifier 21 is proportional to the voltage difference between the voltage $V_S$ and the voltage produced from by reference voltage source 22, hence the pump current is proportional to the oxygen concentration within the exhaust gas. The pump current value is outputted as a value of the voltage appearing between the terminals of current sensing resistor 23**.

When the air/fuel ratio is within the rich region, the voltage $V_S$ will be higher than the output voltage from reference voltage source 22, hence the output voltage from differential amplifier 21 will be inverted from the positive to the negative level. In response to this negative level, the pump current which flows between electrodes **16*a* and 16*b* of the oxygen pump element 18 will be reduced causing the direction of current flow to be reversed. Thus, since the direction of flow of the pump current is now from the electrode 16*b* to electrode 16*a*, oxygen will be ionized by electrode 16*a*, causing the oxygen to be transferred as ions through oxygen pump element 18 to electrode 16*b* and emitted as gaseous oxygen within the gas holding chamber 13. In this way, oxygen is drawn into gas holding chamber 13. The supply of pump current is controlled in order to maintain the oxygen concentration within the gas holding chamber 13** at a constant value, by drawing oxygen into or out of chamber. In this way, the pump current $I_p$ will always be proportional to the oxygen concentration in the exhaust gas, both for operation in the lean region and in the rich region of the air/fuel ratio. The value of the feedback compensation coefficient $K_{O2}$ referred to above is established in accordance with the pump current value $I_p$ in a $K_{O2}$ computation subroutine.

The operating sequence of CPU 47 for the $K_{O2}$ computation subroutine will now be described, referring to the flow chart of FIG. 4.

Figure 4A:
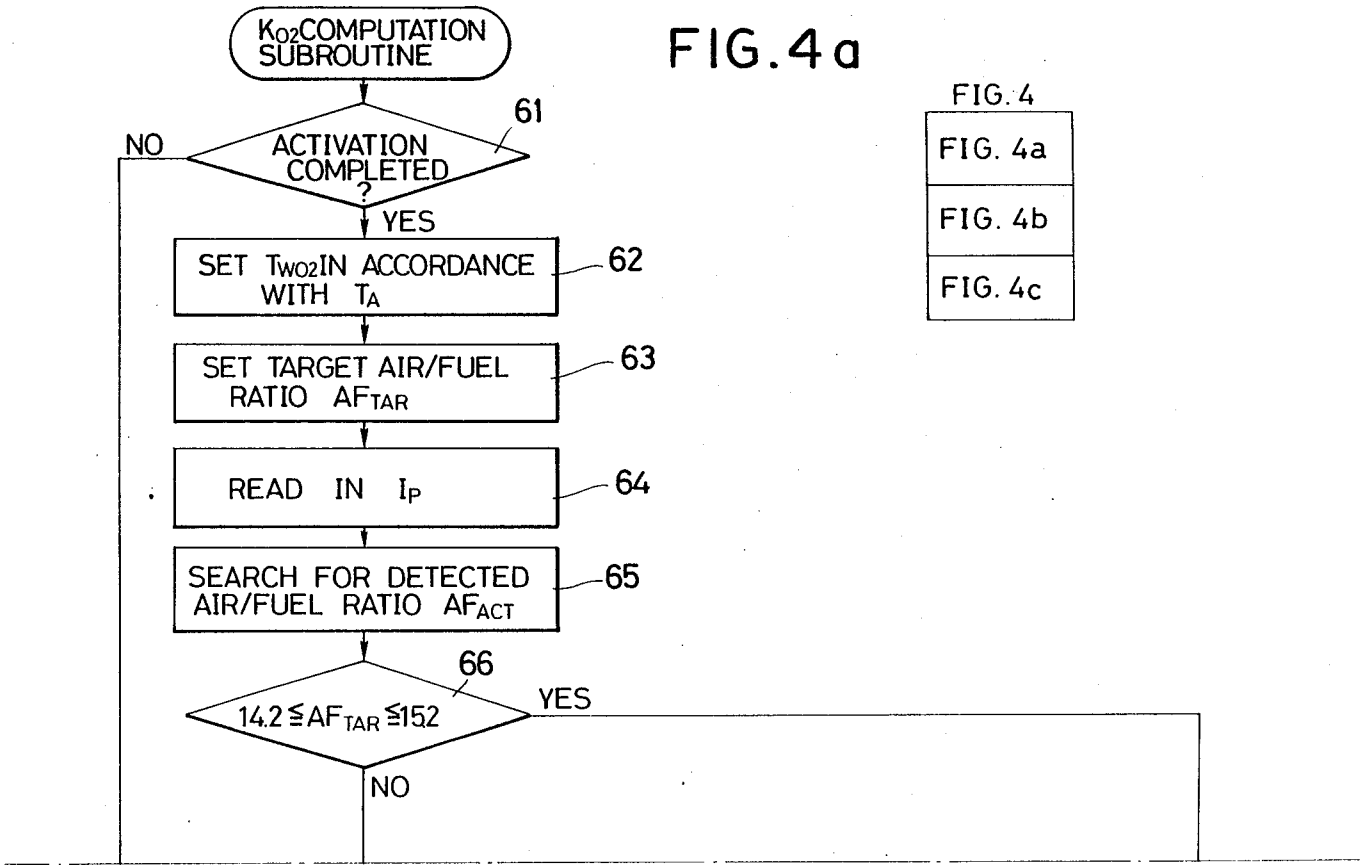
FIGS. 4, 5, 7, and 8 are flow charts for assistance in describing the operation of a CPU.
Figure 4B:
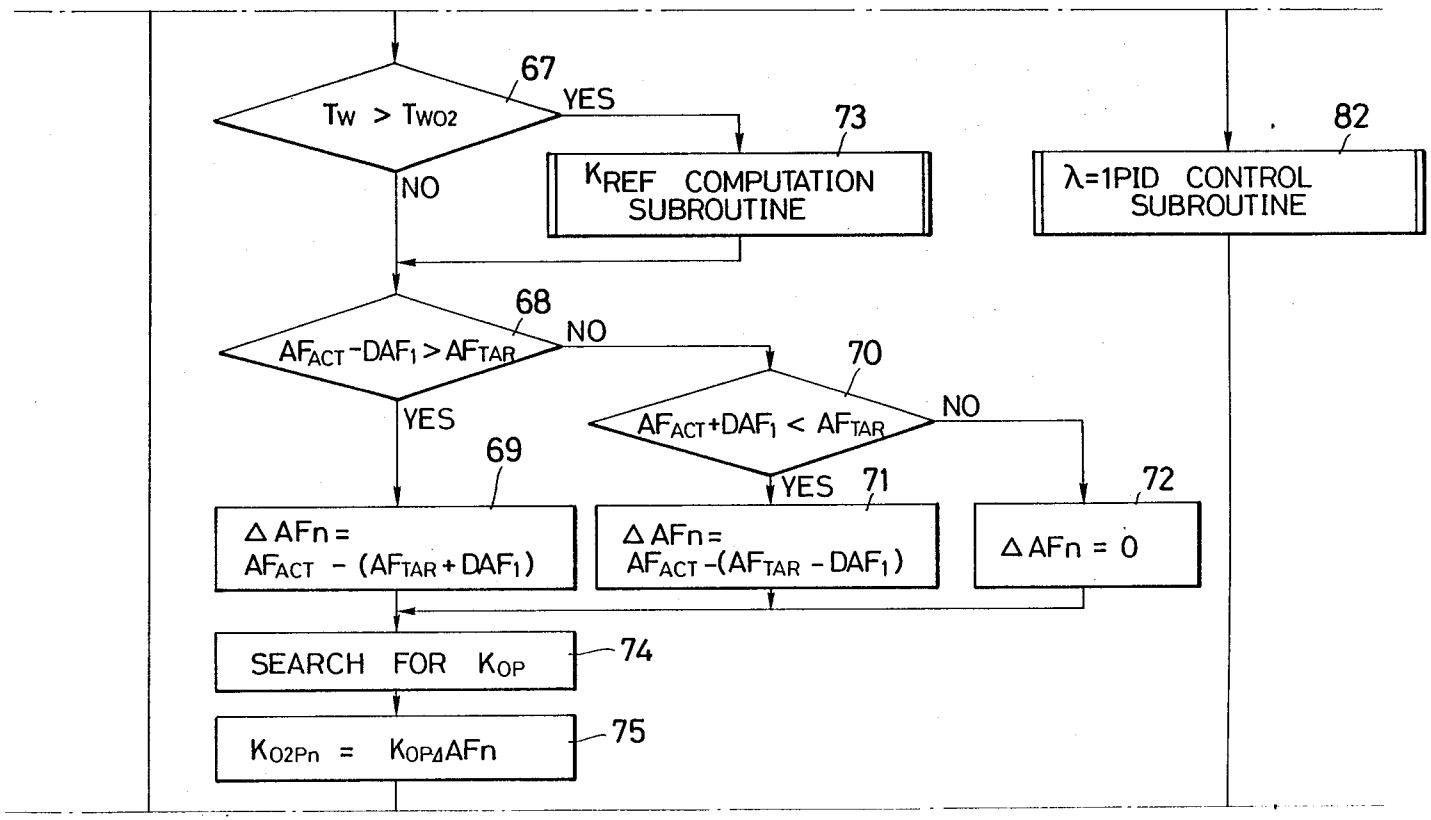
Figure 4C:
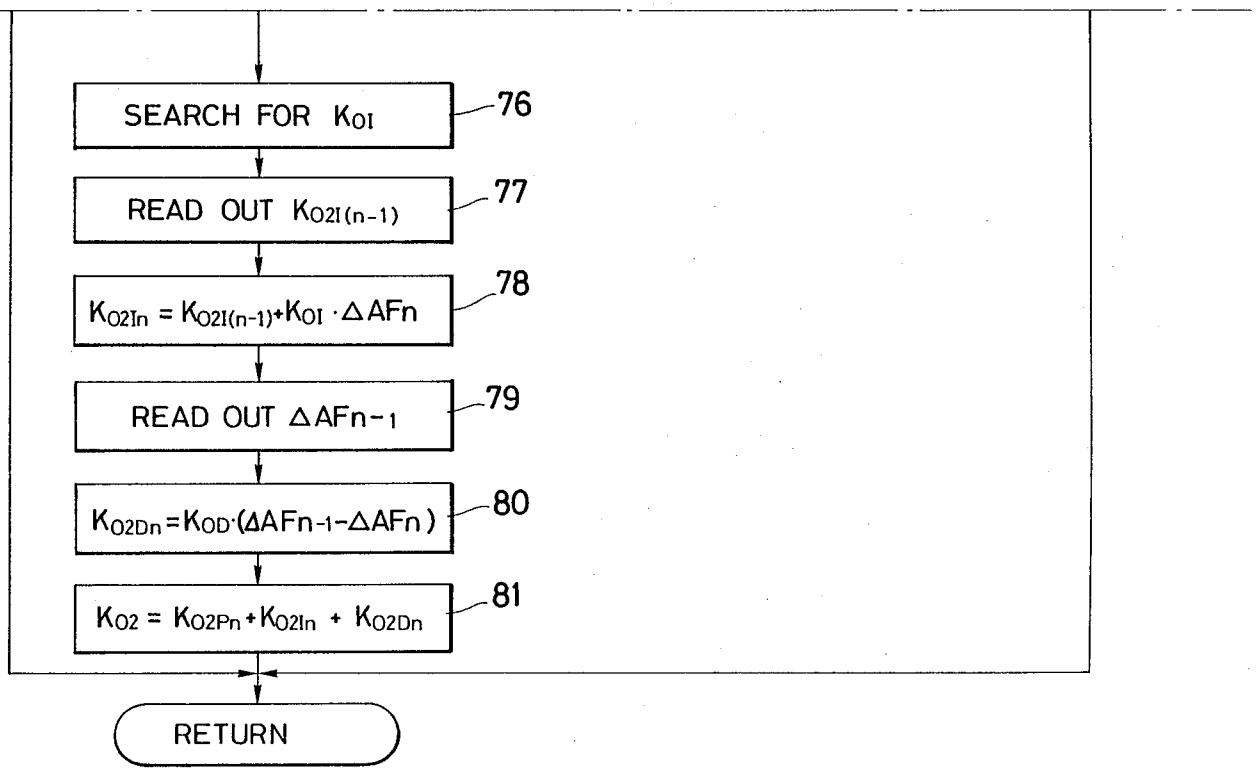
Figure 6:
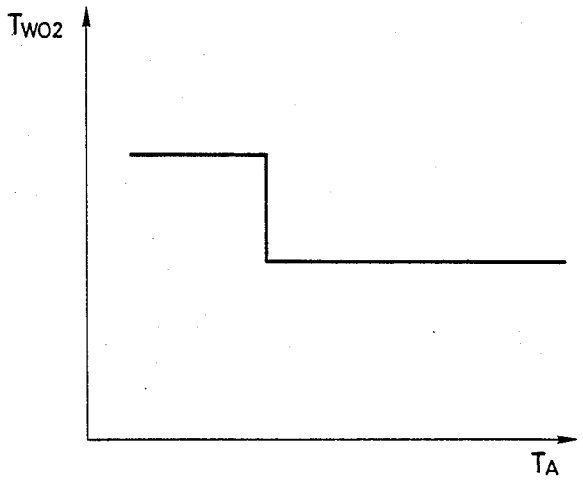
FIG. 6 is a graph showing the relationship between intake temperature $T_A$ and temperature $T_{WO2}$.

In the operating sequence, as shown in FIG. 4, CPU 47 first judges whether or not activation of the oxygen concentration sensor has been completed (step 61). This decision can be based for example upon whether or not a predetermined time duration has elapsed since the supply of heater current to the heater element 20 was initiated, or can be based on the cooling water temperature $T_W$. If activation of the oxygen concentration sensor has been completed, the intake temperature $T_A$ is read and temperature $T_{WO2}$ is set in accordance with this intake temperature $T_A$ (step 62). A characteristic expressing the relationship between intake temperature $T_A$ and temperature $T_{WO2}$, having the form shown graphically in FIG. 6, has been stored beforehand in ROM 48 as a $T_{WO2}$ data map. The temperature $T_{WO2}$ corresponding to the intake temperature $T_A$ that has been read in is obtained by searching this $T_{WO2}$ data map. After setting the temperature $T_{WO2}$, a target air/fuel ratio $AF_{TAR}$ is set in accordance with various types of data (step 63). The pump current $I_p$ is then read (step 64), and the detected air/fuel ratio $AF_{ACT}$ that is expressed by this pump current is obtained from an AF data map (which has been stored beforehand in ROM 48) (step 65). The target air/fuel ratio $AF_{TAR}$ can, for example, be obtained by searching a data map (stored beforehand in ROM 48) which is separate from the AF data map, with the search being executed in accordance with the engine speed $N_e$ and the absolute pressure $P_{BA}$ within the intake pipe. A decision is made as to whether or not the established target air/fuel ratio $AF_{TAR}$ is within the range 14.2 to 15.2 (step 66). If $AF_{TAR}<14.2$, or $>15.2$, then the cooling water temperature $T_W$ is read, in order to execute feedback control of the target air/fuel ratio $AF_{TAR}$ since the target air/fuel ratio value which has been established is excessively different from the stoichiometric air/fuel ratio. A decision is made as to whether or not the cooling water temperature $T_W$ is greater than temperature $T_{WO2}$ (step 67). If $T_W \leqq T_{WO2}$, then a tolerance value $DAF_1$ is subtracted from the detected air/fuel ratio $AF_{ACT}$, and a decision is made as to whether or not the value resulting from this subtraction is greater than the target air/fuel ratio $AF_{TAR}$ (step 68). If $AF_{ACT}-DAF_1>AF_{TAR}$, this indicates that the detected air/fuel ratio $AF_{ACT}$ is leaner than the target air/fuel ratio $AF_{TAR}$, and the quantity $AF_{ACT}-(AF_{TAR}+DAF_1)$ is stored in RAM 49, as the current value of the deviation $\Delta AF_n$ (step 69). If $AF_{ACT}-DAF_1 \leqq AF_{TAR}$, a decision is made as to whether or not the value resulting from adding the tolerance value $DAF_1$ to the detected air/fuel ratio $AF_{ACT}$ is smaller than the target air/fuel ratio $AF_{TAR}$ (step 70). If $AF_{ACT}+DAF_1<AF_{TAR}$, this indicates that the detected air/fuel ratio $AF_{ACT}$ is richer than the target air/fuel ratio $AF_{TAR}$, and the value $AF_{ACT}-(AF_{TAR}-DAF_1)$ is stored in RAM 49 as the current value of deviation $\Delta AF_n$ (step 71). If $AF_{ACT}+DAF_1 \leqq AF_{TAR}$, then this indicates that the detected air/fuel ratio $AF_{ACT}$ is within the tolerance value $DAF_1$ with respect to the target air/fuel ratio $AF_{TAR}$, and so 0 is stored as the current value of deviation $\Delta AF_n$ in RAM 49 (step 72).

If $T_W>T_{WO2}$, then a learning control subroutine is executed (step 73) for renewing a learning correction coefficient $K_{RED}$ determined by the current engine speed Ne and intake manifold absolute pressure $R_{BA}$. Step 68 is then executed, and deviation $\Delta AF_n$ is computed.

When deviation $\Delta AF_n$ has been computed in step 69, 71 or 72, proportional control coefficient $K_{OP}$ is obtained by searching a $K_{OP}$ data map (stored beforehand in ROM 48) in accordance with the engine's rotational speed $N_e$ and the deviation $\Delta AF$ $(=AF_{ACT}-AF_{TAR})$ (step 74). The deviation $\Delta AF_n$ is then multiplied by the proportional control coefficient $K_{OP}$ to thereby compute the present or current value of a proportional component $K_{O2Pn}$ (step 75). In addition, as seen in FIG. 4b, an integral control coefficient $K_{OI}$ is obtained by searching a $K_{OI}$ data map (stored beforehand in ROM 48) in accordance with the engine's rotational speed $N_e$ (step 76). A one-time preceding value of an integral component $K_{O2I(n-1)}$ is then read from RAM 49 (step 77), and the deviation $\Delta AF_n$ is multiplied by the integral control coefficient $K_{OI}$ and a one-time preceding value of the integral component $K_{O2I(n-1)}$ (i.e. the value of this integral component which was obtained in a one-time preceding execution of this subroutine) is added to the result of the multiplication, thereby computing the current value of the integral component $K_{O2In}$ (step 78). The one-time preceding value of deviation $\Delta AF_{n-1}$ (i.e. the value of deviation obtained in a previous execution of this subroutine) is again read from RAM 49 (step 79). The current deviation value $\Delta AF_n$ is then subtracted from a previous deviation value $\Delta AF_{1-1}$, and the result is multiplied by a differential control coefficient $K_{OD}$ computing a current value of differential component $K_{O2Dn}$ (step 80). These values which have thus been computed the proportional component $K_{O2Pn}$, the integral component $K_{O2In}$ and the differential component $K_{O2Dn}$ are then added together, thereby computing the air/fuel ratio feedback compensation coefficient $K_{O2}$ (step 81).

If for example, $AF_{ACT}=11$, $AF_{TAR}=9$ and $DAF_1=1$, it is judged that the air/fuel ratio is lean, and the proportional component $K_{O2Pn}$, the integral component $K_{O2In}$ and the differential component $K_{O2Dn}$ are respectively computed by using a value $\Delta AF_n=1$. For the case in which $AF_{ACT}=7$, $AF_{TAR}=9$ and $DAF_1=1$, then it is judged that the air/fuel ratio is rich, and the proportional component $K_{O2Pn}$, the integral component $K_{O2In}$ and the differential component $K_{O2Dn}$ are respectively computed by using a value $\Delta AF_n=1$. If $AF_{ACT}=11$, $AF_{TAR}=10$ and $DAF_1=1$, then it is judged that the detected $AF_{ACT}$ is within the tolerance value $DAF_1$ with respect to the target air/fuel ratio $AF_{TAR}$, and therefore $\Delta AF_n$ is made equal to zero. If the latter condition continues, both $K_{O2Pn}$ and $K_{O2Dn}$ are set to zero, and feedback control is executed in accordance with the integral component $K_{O2In}$ alone. The proportional control coefficient $K_{OP}$ is established in accordance with the engine speed $N_e$ and the deviation $\Delta AF$, so that, $K_{OP}$ is based upon considerations of the deviation of the detected air/fuel ratio from the target air/fuel ratio and the flow speed of the intake mixture. As a result, improved control response speed is attained with respect to changes in the air/fuel ratio.

If on the other hand, for example, it is judged in step 66 that $14.2 < AF_{TAR} < 15.2$, feedback control is applied by executing the $\lambda=1$PID control subroutine, utilizing a value of target air/fuel ratio which is equal to the stoichiometric air/fuel ratio (step 82).

Figure 5A:
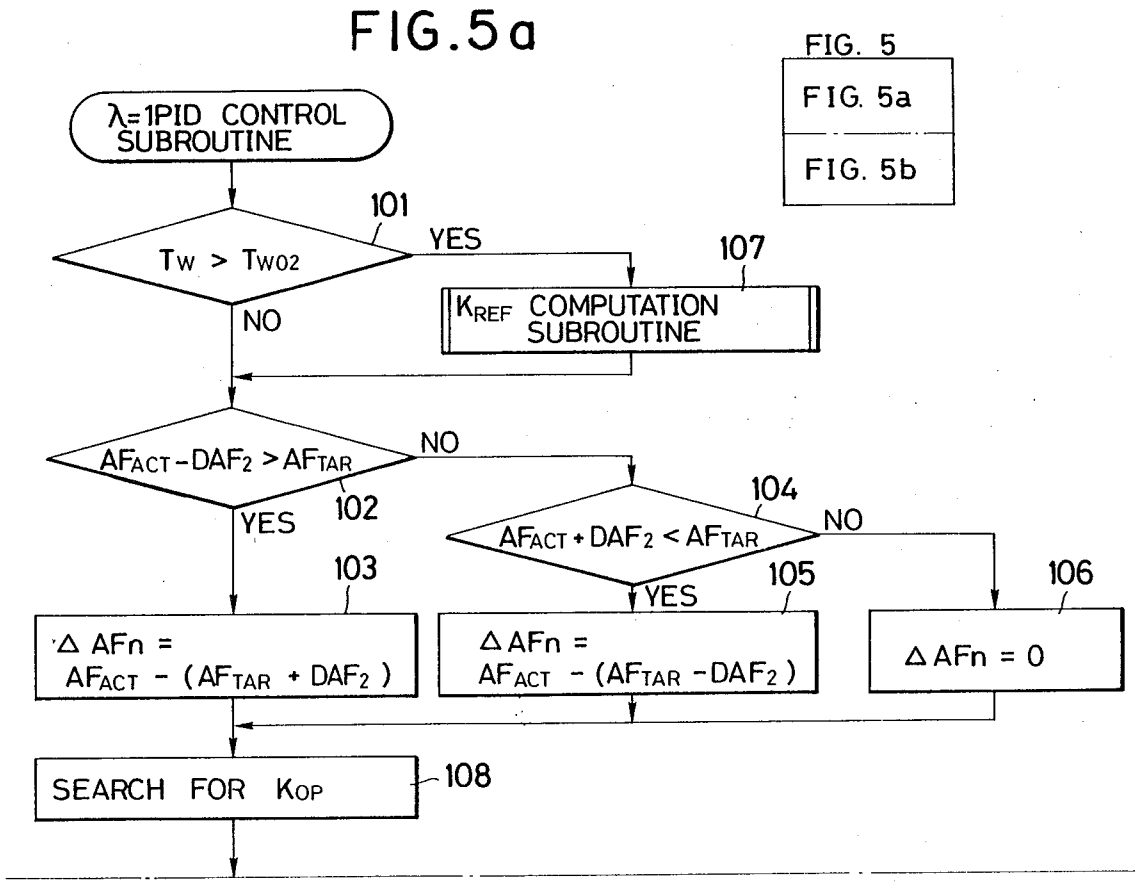
Figure 5B:
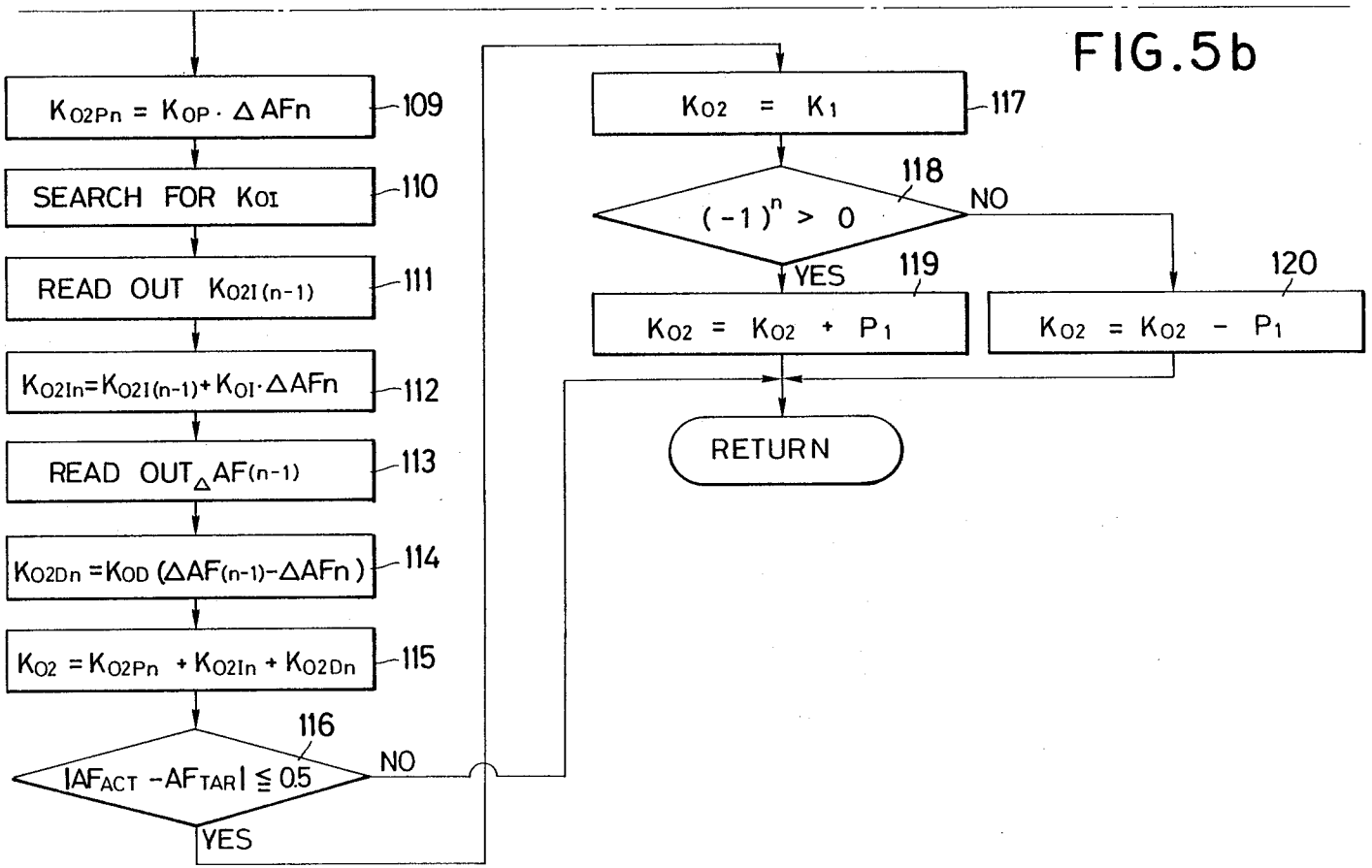

In the $\lambda=1$pID control subroutine, as shown in FIG. 5, the cooling water temperature $T_W$ is first read, and a decision is made as to whether or not $T_W$ is higher than temperature $T_{WO2}$ (step 101). If $F_W \leqq T_{WO2}$, the tolerance value $DAF_2$ is subtracted from the detected air/fuel ratio $AF_{ACT}$, and a decision is made as to whether or not the value is greater than the target air/fuel ratio $AF_{TAR}$ (step 102). If $AF_{ACT}-DAF_2>AF_{TAR}$, this indicates that the detected air/fuel ratio $AF_{ACT}$ is leaner than the target air/fuel ratio $AF_{TAR}$, and therefore the value $AF_{ACT}-(AF_{TAR}+DAF_a)$ is stored in RAM 49 as the current value of deviation $\Delta AF_n$ (step 103). If $AF_{ACT}-DAF_2 \leqq AF_{TAR}$, the detected air/fuel ratio $AF_{ACT}$ is added to the tolerance value $DAF_2$, and a decision is made as to whether or not the result is smaller than the target air/fuel ratio $AF_{TAR}$ (step 104). If $AF_{ACT}+DAF_2<AF_{TAR}$, this indicates that the detected air/fuel ratio $AF_{ACT}$ is richer than the target air/fuel ratio $AF_{TAR}$, and therefore the value $AF_{ACT}-(AF_{TAR}-DAF_2)$ is stored in RAM 49 as the current value of deviation $\Delta AF_n$ (step 105). If $AF_{ACT}+DAF_2 \geqq AF_{TAR}$, this indicates that the detected air/fuel ratio $AF_{ACT}$ is within the tolerance value $DAF_2$ with respect to the target air/fuel ratio $AF_{TAR}$, and the current value of deviation $\Delta AF_n$ is set to zero, and stored in RAM 49 (step 106).

If $T_W>T_{WO2}$, the $K_{REF}$ computation subroutine is executed in order to compute and update the learning correction coefficient $K_{REF}$ in accordance with the current operating region of the engine (as determined by the engine's rotational speed $N_e$ and the absolute pressure $P_{BA}$ within the intake pipe (step 107). Step 102 is then executed to compute the deviation $\Delta AF_n$.

After computing the deviation $\Delta AF_n$ in step 103, 105 or 106, the proportional control coefficient $K_{OP}$ is obtained by searching a $K_{OP}$ data map (stored beforehand in ROM 48). This search is performed in accordance with the engine's rotational speed $N_e$ and the deviation $\Delta AF$ ($=AF_{ACT}-AF_{TAR}$) (step 108). The value of proportional control coefficient $K_{OP}$ is multiplied by the deviation $\Delta AF_n$ to compute the current value of the proportional component $K_{O2Pn}$ (step 109). The integral control coefficient $K_{OI}$ is then obtained by searching a $K_{OI}$ data map (stored beforehand in ROM 48), in accordance with the engine's rotational speed $N_e$ (step 110), and a one-time preceding value of the integral component $K_{O2I(n-1)}$ (obtained in a one-time preceding execution of this subroutine) is then read from RAM 49 (step 111). The integral control coefficient $K_{OI}$ is multiplied by the deviation $\Delta AF_n$, and the integral component $K_{O2I(n-1)}$ is added to the result, thereby computing the current value of the integral component $K_{O2In}$ (step 112). The one-time preceding value of deviation $\Delta AF_{n-1}$ is again read from RAM 49 (step 113), and the current value of deviation $\Delta AF_n$ is then subtracted from $\Delta AF_{n-1}$ with the result of this subtraction is multiplied by a predetermined value of differential control coefficient $K_{OD}$ thereby computing the current value of the differential component $K_{O2Dn}$ (step 114). The values of proportional component $K_{O2Dn}$, integral component $K_{O2In}$ and differential component $K_{O2Dn}$ are then added together, thereby computing the air/fuel ratio feedback compensation coefficient $K_{O2}$ (step 115).

After computing the air/fuel ratio feedback compensation coefficient $K_{O2}$, the target air/fuel ratio $AF_{TAR}$ is subtracted from the detected air/fuel ratio $AF_{ACT}$, and a decision is made as to whether or not the absolute value of the result is lower than 0.5 (step 116). If $|AF_{ACT}-AF_{TAR}| \leqq 0.5$, then the compensation coefficient $K_{O2}$ is made equal to a predetermined value $K_1$ (step 117), and a decision is made as to whether or not $(-1)^n$ is greater than zero (step 118). If $(-1)^n>0$, then a predetermined value $P_1$ is added to the compensation coefficient $K_{O2}$, and the result is made the compensation coefficient $K_{O2}$ (step 119). If $(-1)^n \leqq 0$, then the predetermined value $P_1$ is subtracted from the compensation coefficient $K_{O2}$, and the resultant value is made the compensation coefficient $K_{O2}$ (step 120). If $|AF_{ACT}-AF_{TAR}|>0.5$, then the value of compensation coefficient $K_{O2}$ which was computed in step 115 is unchanged. The predetermined value $K_1$ can, for example, be the value of compensation coefficient $K_{O2}$ which is necessary in order to control the air/fuel ratio to a value of 14.7.

Thus, if the condition $|AF_{ACT}-AF_{TAR}| \leqq 0.5$ is continued while the target air/fuel ratio $AF_{TAR}$ is close to the stoichiometric air/fuel ratio, then the value of the air/fuel ratio feedback compensation coefficient $K_{O2}$ will be alternately set to $K_{O2}+P_1$ and $K_{O2}-P_1$ as successive TDC signal pulses are produced. The fuel injection time interval $T_{OUT}$ is computed by using the value of compensation coefficient $K_{O2}$ obtained as described above, from equation (1) given hereinabove and the fuel injection into engine 2 is performed by injector 36 for the precise duration of this fuel injection interval $T_{OUT}$. In this way, the air/fuel ratio of the mixture supplied to the engine will oscillate slightly, between the rich and the lean regions, about a central value of approximately 14.7. Perturbations are thereby induced within the engine cylinders, thereby augmenting the effectiveness of pollutant reduction by the catalytic converter.

In step 62, the temperature $T_{WO2}$ is set in order to judge the cooling water temperature $T_W$ in relation to the air intake temperature $T_A$. The reason for this is that the lower the air intake temperature, the greater the amount of fuel which will adhere to the interior surface of the intake pipe. Fuel increment compensation is applied by means of the compensation coefficient $K_{TW}$. However the compensation coefficient $K_{O2}$ is used in computing the learning correction coefficient $K_{REF}$, and since the amount of fuel which adheres to the interior of the intake pipe will vary depending upon engine operating conditions, the accuracy of controlling the air/fuel ratio of the mixture supplied to the engine in accordance with the oxygen concentration sensor output will be decreased. In addition, the accuracy of the compensation coefficient $K_{O2}$ will be reduced. Thus, when $T_W>T_{WO2}$ a computed value of $K_{O2}$ is used to compute so as to update the learning correction coefficient $K_{REF}$.

Figure 7:
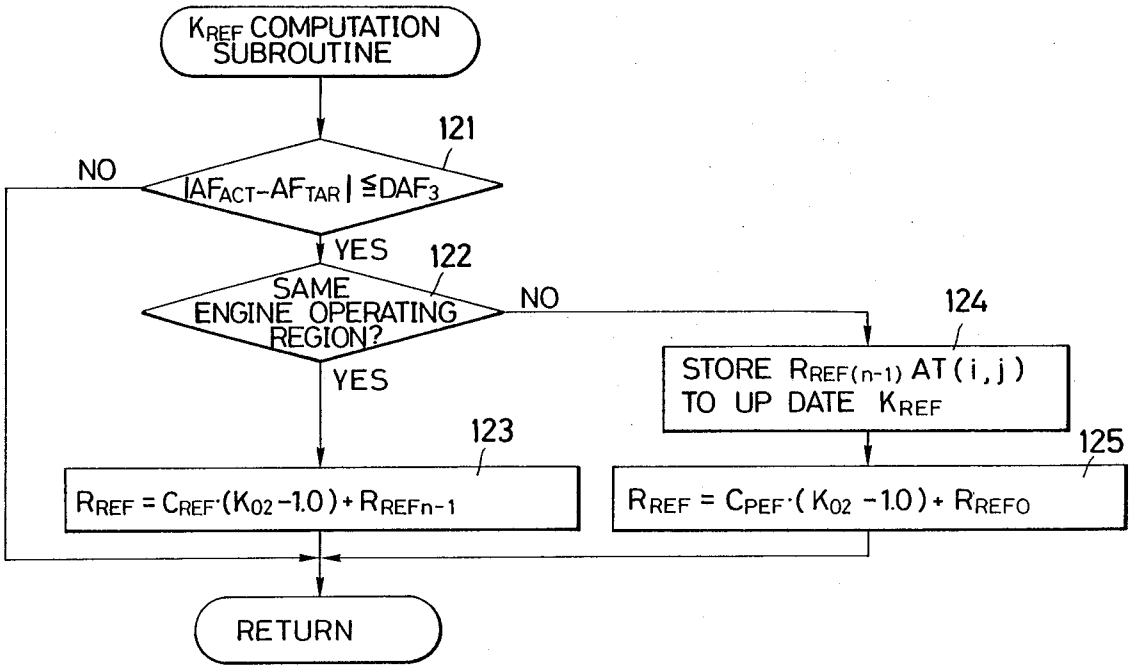

A $K_{REF}$ computation subroutine according to a first embodiment of the present invention will be described referring to FIG. 7. First, CPU 47 judges whether or not the absolute value of the difference between the detected air/fuel ratio $AF_{ACT}$ and the target air/fuel ratio $AF_{TAR}$ is lower than a predetermined value $DAF_3$ (for example, 1) (step 121). If $|AF_{ACT}-AF_{TAR}|>DAF_3$, the execution of the $K_{REF}$ subroutine is halted, and execution returns to the original routine. If $|AF_{ACT}-AF_{TAR}| \leqq DAF_3$, a decision is made as to whether or not the current operating condition of the engine (determined in accordance with engine's rotational speed $N_e$ and the absolute pressure $P_{BA}$ within the intake pipe) used in searching the $K_{REF}$ data map for the learning correction coefficient $K_{REF}$ is the same as that during the preceding execution of the $K_{REF}$ subroutine, i.e. a decision is made as to whether or not the memory location (i,j) which is utilized in searching the $K_{REF}$ data map during this execution of the subroutine is identical to the memory location (designated as $(i,j)_{n-1}$) which was utilized previously (step 122). The "i" quantity in memory location (i,j) is a value selected from among the values 1, 2, . . . x, in accordance with the current engine speed of rotation $N_e$, while the "j" quantity is selected from among the values 1, 2, . . . y, in accordance with the current degree of absolute pressure $P_{BA}$ within the intake pipe. If $((i,j)=(i,j)_{n-1}$, then a compensation coefficient $R_{REF}$, which is a provisional value of the learning correction coefficient $K_{REF}$, is computed and is stored in RAM 49 (step 123). The provisional compensation coefficient $R_{REF}$ is computed from the following equation:

$$R_{REF}=C_{REF}(K_{O2}-1.0)+R_{REF(n-1)} \quad (2)$$

In the above, $C_{REF}$ is convergence coefficient. $R_{REF(n-1)}$ is the compensation coefficient which was computed in the one-time preceding execution of the routine, and which is read from RAM 49. If $(i,j)\neq(i,j)_{n-1}$, this indicates that the engine has entered a new operating region, and therefore the previously computed compensation coefficient $R_{REFn-1}$ is read from RAM 49 and that value is then stored in memory location $(i,j)_{n-1}$ as the compensation coefficient $K_{REF}$, thereby updating $K_{REF}$ (step 124). The compensation coefficient $R_{REF}$ then computed and is stored in RAM 49 (step 125). In this case, the compensation coefficient $R_{REF}$ is obtained from the following equation:

$$R_{REF}=C_{REF}(K_{O2}-1.0)+R_{FEFo} \quad (3)$$

In the above equation, $R_{REFo}$ is a value of compensation coefficient $R_{REF}$ for the new engine operating region, which has been stored in memory. If engine operation in this region is continued thereafter, then the value of compensation coefficient $R_{REF}$ which is computed in step 125 is used as the compensation coefficient $R_{REFn-1}$ in step 123 during the next execution of the $K_{REF}$ computation subroutine.

With this $K_{REF}$ computation subroutine, the compensation coefficient $R_{REF}$ is computed such as to make the value of the compensation coefficient $K_{O2}$ equal to 1.0 only if $|AF_{ACT}-AF_{TAR}|\leqq DAF_3$. If the engine operating region changes, then the value of compensation coefficient $K_{REF}$ that was obtained for the preceding engine operating region is updated by executing what is called "learning control". The reason for computing the compensation coefficient $R_{REF}$ only under the condition that $|AF_{ACT}-AF_{TAR}|\leqq DAF_3$ is that even under steady-state engine operating conditions, large changes in the exhaust gas oxygen concentration can occur. When this happens, the air/fuel ratio feedback compensation coefficient $K_{O2}$ that is computed will not have a sufficiently high degree of accuracy for use in compensation, and therefore the compensation coefficient $R_{REF}$ is obtained by using equations (2) or (3) above, thereby performing result in erroneous correction of the compensation coefficient $K_{REF}$. For example, immediately following a change of engine operation from a high load condition to a normal operating condition, the detected oxygen concentration will contain a component which represents the increased amount of fuel which was supplied during the high load operating condition, and therefore there will be a delay before the computed value of the compensation coefficient $K_{O2}$ will be corrent with respect to the current engine operating status. Hence, errors will arise in the compensation coefficient $K_{REF}$, and it is for this reason that learning control operation is executed in the event that $|AF_{ACT}-AF_{TAR}|\leqq DAF_3$.

Figures 8, 8A, 8B:
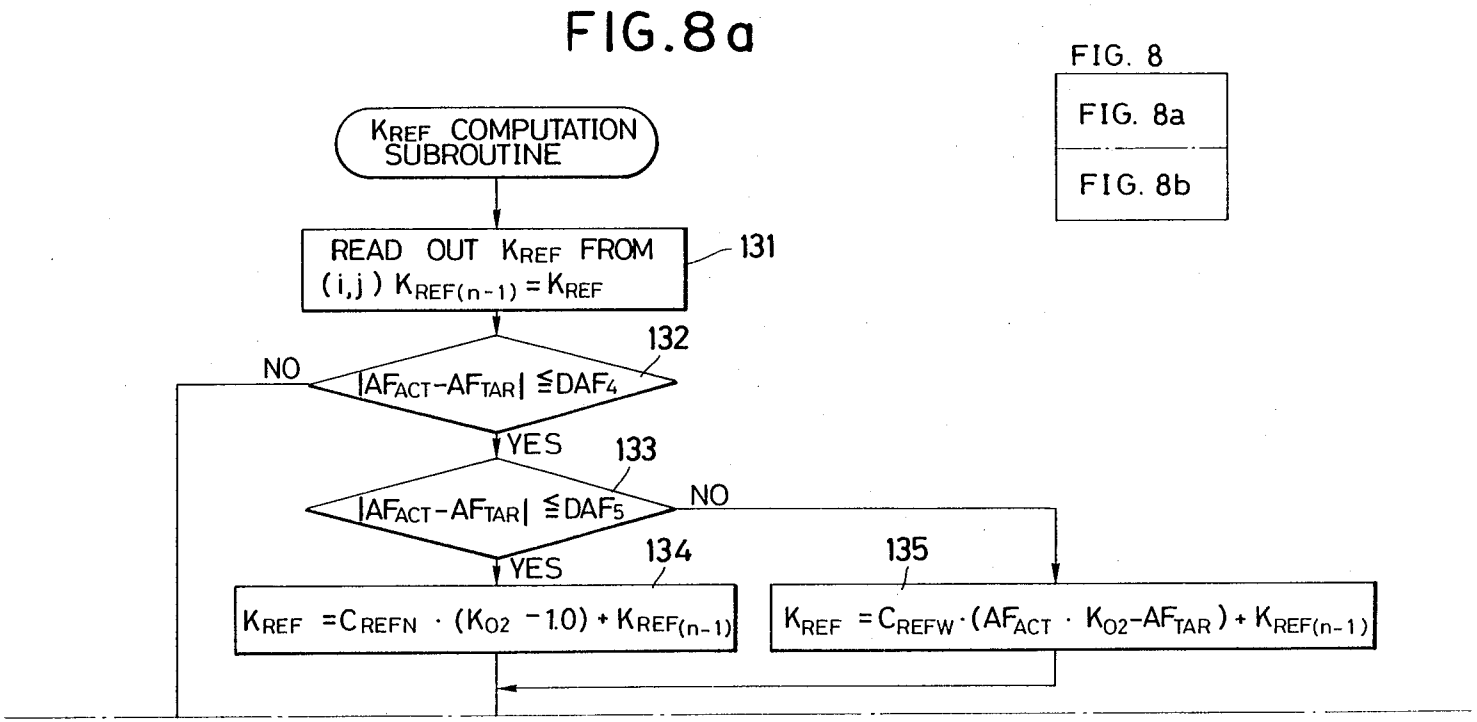
Figure 8B:
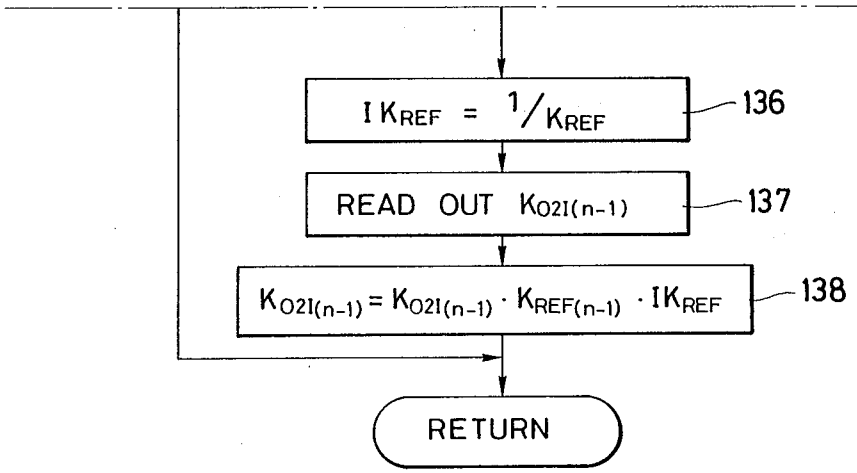

A $K_{REF}$ computation subroutine according to a second embodiment of the invention will now be described, referring to FIG. 8. First, the compensation coefficient $K_{REF}$ that corresponds to the current engine operating condition (determined in accordance with engine's rotational speed $N_e$ and the absolute pressure $P_{BA}$ within the intake pipe) is read from the $K_{REF}$ data map, i.e. from memory location (i,j), and this value of $K_{REF}$ is then designated as the previous value $K_{REF(n-1)}$ (step 131). The CPU then judges whether or not the absolute value of the difference between the detected air/fuel ratio $AF_{ACT}$ and the target air/fuel ratio $AF_{TAR}$ is lower than a predetermined value $DAF_4$ (for example, 1) (step 132). If $|AF_{ACT}-AF_{TAR}|>DAF_4$, the execution of the $K_{REF}$ subroutine is halted, and execution returns to the original routine. If $|AF_{ACT}-AF_{TAR}|\leqq DAF_4$, a decision is made as to whether or not $|AF_{ACT}-AF_{TAR}|$ is lower than a predetermined value $DAF_5$ ($DAF_4>DAF_5$, for example $DAF_5=0.5$) (step 133). If $|AF_{ACT}-AF_{TAR}|\leqq DAF_5$, the compensation coefficient $K_{REF}$ is computed from the following equation, and stored at memory location (i,j) in the $K_{REF}$ data map (step 134).

$$R_{REF}=C_{REFN}(K_{O2}-1.0)+K_{REF(m31\ 1)} \quad (4)$$

In the above, $C_{REFN}$ is a convergence coefficient.

If on the other hand $|AF_{ACT}-AF_{TAR}|>DAF_5$, the compensation coefficient $K_{REF}$ is computed by the following equation and and stored at memory location (i,j) of the $K_{REF}$ data map (step 135).

$$K_{REF}=C_{REFW}(AF_{ACT}k_{O2}-AF_{TAR})+K_{REF(n-1)} \quad (5)$$

In the above, $C_{REFW}$ is a convergence coefficient, where $C_{REFW}>C_{REFN}$ When the compensation coefficient $K_{REF}$ for memory location (i,j) of the $K_{REF}$ data map has been computed and updated in this way, the inverse of that value of $K_{REF}$, designated as $IK_{REF}$, is computed (step 136). The previously obtained integral component $K_{O2I(n-1)}$ is then read from RAM 49 (step 137), and this integral component $K_{O2I(n-1)}$, the precedingly obtained value $K_{REF(n-1)}$, and the inverse value $IK_{REF}$ are multiplied together, and the result of this multiplication is designated as the integral component $K_{O2I(n-1)}$ and stored in RAM 49 (step 138). When this subroutine is next executed, the one-time preceding integral component $K_{O2I(n-1)}$ that was stored in this way in step 138 is utilized in step 78 or step 112 to compute the current integral component $K_{O2In}$. In this way, improved accuracy of response is obtained with respect to changes in the air/fuel ratio.

With the $K_{REF}$ computation subroutine described above, the compensation coefficient $K_{REF}$ is only computed such that the compensation coefficient $K_{O2}$ will be made equal to 1.0 if $|AF_{ACT}-AF_{TAR}|\leqq DAF_4$.

Normally, the compensation coefficient $K_{REF}$ will be updated in accordance with the current engine operating region, and learning control executed. When the compensation coefficient K;hd REF is computed and if $|AF_{ACT}-AT_{TAR}|>DAF_5$, the compensation coefficient $R_{REF}$ is made higher than in the case in which $|AF_{ACT}-AR_{TAR}|\leqq DAF_5$, thereby increasing the speed of compensation.

With air/fuel ratio control method according to the present invention, as described hereinabove, the computation of a compensation value and updating of that value is performed only if the deviation from the target air/fuel ratio is of the air/fuel ratio detected in the output of an oxygen concentration sensor and this deviation is lower than a predetermined value. Furthermore, when the deviation of the detected air/fuel ratio from the target air/fuel ratio is lower than that predetermined value, the compensation value is computed in accordance with that deviation. In this way, when a large change occurs in the oxygen concentration of the engine exhaust gas, calculation of the provisional compensation value ($R_{REF}$) that is used to compensate for errors in the basic value is halted. Undue fluctuations between the provisional compensation values can thereby be prevented, so that, highly accurate air/fuel ratio control and enhanced elimination of exhaust pollutants is attained, using an oxygen concentration sensor producing an output which varies in proportion to oxygen concentration.

What is claimed is:

1. A method for controlling an air/fuel ratio of a mixture supplied to an internal combustion engine equipped with an oxygen concentration sensor disposed in an exhaust system by producing an output varying substantially in proportion to an oxygen concentration in an exhaust gas of the engine, the method comprising:

setting a basic value to control the air/fuel ratio, in response to a plurality of engine operating parameters relating to engine load;

detecting the actual air/fuel ratio of the mixture based upon the oxygen concentration sensor output;

compensating said basic value by an air/fuel ratio feedback compensation value which is derived in response to a deviation of the detected air/fuel ratio from a target air/fuel ratio and by a learning control compensation value which compensates for an error of the oxygen concentration sensor occurring due to infrequent changes in values of said sensor's characteristics, thereby determining an output value with respect to said target air/fuel ratio;

controlling the air/fuel ratio of said mixture in response to said output value; and computing and updating said learning control compensation value when an absolute value of said deviation is lower than a predetermined value.

2. A method of air/fuel ratio control as claimed in claim 1, wherein said learning control compensation value is updated for each operational region of the engine varying in response to said plurality of engine operating parameters.

3. A method of air/fuel ratio control as claimed in claim 1, wherein said learning control compensation value is a mean value of said air/fuel ratio feedback compensation value and a previous learning control compensation value.

4. A method of air/fuel ratio control as claimed in claim 1, wherein said error of the oxygen concentration sensor is due to infrequent changes caused by aging and deterioration.

5. A method of controlling an air/fuel ratio of a mixture supplied to an internal combustion engine equipped with an oxygen concentration sensor disposed in an exhaust system for producing an output varying substantially in proportion to an oxygen concentration in an exhaust gas of said engine, the method comprising:

setting a basic value for controlling the air/fuel ratio, in response to a plurality of engine operating parameters relating to engine load;

detecting the air/fuel ratio of the mixture based upon the oxygen concentration sensor output;

compensating said basic value by an air/fuel ratio feedback compensation value which is derived in response to a deviation of the detected air/fuel ratio from a target air/fuel ratio and by a learning control compensation value which compensates for an error of the oxygen concentration sensor occurring due to infrequent changes in values in said sensor's characteristics, thereby determining an output value with respect to said target air/fuel ratio;

controlling the air/fuel ratio of said mixture in response to said output value;

computing and updating said learning control compensation value causing a change in value when an absolute value of said deviation is lower than a predetermined value; and changing a speed of the change in value of said learning control compensation value during said computing and updating step in response to said absolute value of the deviation.

6. A method of air/fuel ratio control as claimed in claim 5, wherein computations are executed such that the higher the absolute value of said deviation, the higher the speed of the change in value of said learning control compensation during said computing and updating step.

7. A method of air/fuel ratio control as claimed in claim 5, wherein said learning control compensation value is a mean value of said air/fuel ratio feedback compensation value and a previous learning control compensation value.

8. A method of air/fuel ratio control as claimed in claim 5, wherein said error of the oxygen concentration sensor is due to infrequent changes caused by aging and deterioration.

* * * * *